US005595345A

United States Patent [19]

Chura et al.

[11] Patent Number: 5,595,345

[45] Date of Patent: Jan. 21, 1997

[54] DOUBLE BARREL SPRAYER FOR SELECTIVE SPRAYING OF WATER OR DILUTED PRODUCT AND USE THEREOF

[75] Inventors: William D. Chura, Ridgefield; Edward Kozlowski, Southport; Lance Liljeqvist, Wilton; Stephen Jones, Darien, all of Conn.; Mark Thompson, Charleston; Charles Hawes, Summerville, both of S.C.

[73] Assignee: Armor All Products Corporation, Charleston, S.C.

[21] Appl. No.: 511,142

[22] Filed: Aug. 4, 1995

Related U.S. Application Data

[63] Continuation-in-part of Ser. No. 451,922, May 26, 1995, abandoned.

[51] Int. Cl.[6] ..... B05B 9/00

[52] U.S. Cl. ..... 239/312; 239/318; 239/427.3; 239/444

[58] Field of Search ..... 239/310, 312, 239/314, 316, 317, 318, 390, 391, 103, 444–6, 427, 427.3, 596, 600

[56] References Cited

U.S. PATENT DOCUMENTS

| | | | |
|---|---|---|---|
| 2,646,063 | 7/1953 | Hayes | 137/218 |
| 3,104,813 | 9/1963 | Baatrup | 236/102 |
| 3,104,825 | 9/1963 | Hayes | 239/407 |
| 3,106,347 | 10/1963 | Hayes | 239/505 |
| 3,134,545 | 5/1964 | Armond | 239/312 |
| 3,181,797 | 5/1965 | Hayes | 239/317 |
| 3,201,049 | 8/1965 | Hayes | 239/433 |
| 3,207,443 | 9/1965 | Gilmour | 239/312 |
| 3,381,899 | 5/1968 | Forsman | 239/317 |
| 3,799,453 | 3/1974 | Hart | 239/391 |
| 4,057,505 | 11/1977 | Nakagawa et al. | 252/96 |
| 4,071,463 | 1/1978 | Steinhauer | 252/103 |
| 4,113,645 | 9/1978 | DeSimone | 252/187 H |
| 4,116,851 | 9/1978 | Rupe et al. | 252/103 |
| 4,382,552 | 5/1983 | Lubsen et al. | 239/317 |
| 4,473,328 | 9/1984 | Hengesbach | 239/310 |
| 4,789,495 | 12/1988 | Cahall et al. | 252/95 |
| 4,806,263 | 2/1989 | Leathers et al. | 252/106 |
| 5,039,016 | 8/1991 | Gunzel et al. | 239/314 |
| 5,100,059 | 3/1992 | Englhard et al. | 239/310 |
| 5,213,265 | 5/1993 | Englhard et al. | 239/310 |
| 5,223,168 | 6/1993 | Holt | 252/142 |
| 5,290,470 | 3/1994 | Dutcher | 252/102 |
| 5,383,603 | 1/1995 | Englhard et al. | 239/314 |

OTHER PUBLICATIONS

*BIX Exterior House Washer,* Manufactured by BIX Products Group, Inc., Old Hickory, TN 37138, Printed in U.S.A. Product No. 2700. (no date given).

*Primary Examiner*—Andres Kashnikow
*Assistant Examiner*—Lisa Ann Douglas
*Attorney, Agent, or Firm*—Burns, Doane, Swecker & Mathis, L.L.P.

[57] ABSTRACT

A double barrel sprayer for applying a diluted product such as a diluted cleaning solution to a surface for cleaning thereof and rinsing the diluted product from the surface by spraying a water-only rinse onto the surface. The sprayer can include a force-fitted orifice plate with a plurality of holes for adjusting the water/product mixing ratio. To provide different spray patterns for the water-rinse or diluted product, the sprayer can include a shroud having suitably shaped exit holes. The sprayer includes separate flow paths for the water-only rinse and the diluted product. The flow path for the diluted product includes a mixing chamber in which concentrated product is siphoned from a container and mixed with water supplied by a garden hose. Prior to mixing with the water, the concentrated product passes through an orifice plate having a plurality of holes to provide a substantially constant water/product ratio over a wide range of water pressures. The sprayer includes a removable cover which includes a pair of outlets suitably sized and shaped to obtain desirable spray patterns for the water-only rinse and the diluted product sprayed from the sprayer. A rotatable valve allows selective application of water or diluted product.

25 Claims, 4 Drawing Sheets

DOUBLE BARREL SPRAYER FOR SELECTIVE SPRAYING OF WATER OR DILUTED PRODUCT AND USE THEREOF

This is a continuation-in-part of application Ser. No. 08/451,922 filed May 26, 1995, now abandoned.

FIELD OF THE INVENTION

The invention relates generally to mixing and dispensing sprayers and more particularly to a sprayer for use in mixing a concentrated liquid product with water in a desired water/product ratio and spraying the diluted product onto a surface to be treated. The sprayer also can be used to apply a water-only rinse to remove the product from the surface.

BACKGROUND OF THE INVENTION

Sprayers for mixing and dispensing liquids into a carrier fluid such as water are disclosed in U.S. Pat. Nos. 3,201,049; 3,381,899; 5,039,016; 5,100,059; 5,213,265; and 5,383,603. Such sprayer arrangements typically include an inlet for a hose such as a garden hose and an inlet for a siphon tube for removing product from a container attached to the sprayer. The sprayer arrangements vary in complexity and typically spray a water/product mixture or water-only through a common outlet of the sprayer. Further, in some of the prior an arrangements, the product to be mixed with water is mixed in a chamber exposed to the atmosphere which results in fluctuation in the water/product ratio. Another disadvantage of such prior an sprayers is that they may not be capable of delivering a water/product mixture or water-only rinse over a suitable distance.

There is a need in the art for a sprayer apparatus for cleaning buildings which can provide selective application of a water/product mixture or water-only rinse at distances capable of reaching the entire wall surface of a two-story building, providing a desired water/product mixing ratio over the wide range of water pressures typically found in residential garden hoses and/or providing adaptability with respect to the desired water/product mixing ratio and/or shape of spray patterns of the product/water mixture and water-only rinse spray patterns provided by the sprayer.

SUMMARY OF THE INVENTION

The invention provides a portable double barrel sprayer for applying a diluted liquid product to a surface to be treated. The sprayer includes a housing having first and second inlets, first and second outlets, a mixing chamber and a valve member. The first inlet is attachable to a hose which supplies water to the sprayer, the second inlet is attachable to a container which supplies a concentrated liquid product to the sprayer, and the mixing chamber is in fluid communication with the first and second inlets such that water is mixed with the concentrated liquid product to form a diluted product by feeding water through the first inlet and feeding the concentrated liquid product through the second inlet. The first outlet sprays rinsing water from the sprayer to allow removal of diluted product from a surface to be treated, the second outlet sprays the diluted product from the sprayer onto a surface to be treated, and the valve member selectively feeds the diluted product to the second outlet or feeds only rinsing water to the first outlet.

The sprayer can include a variety of optional features. For instance, the sprayer can include a siphoning tube extending into a container of the concentrated liquid product such that the second inlet is in fluid communication with the siphoning tube. The concentrated product can be removed from the container by feeding water through the mixing chamber and siphoning the concentrated product from the container. The shape of the spray patterns can be controlled by a cover member attached to the housing such that a first outlet of desired shape of the cover member is in fluid communication with the first outlet of a housing and the second outlet of desired shape of the cover member is in fluid communication with the second outlet of the housing. The sprayer can include an orifice member in fluid communication with the second inlet such that a plurality of passages through the orifice member supply concentrated product to the mixing chamber in a substantially constant water/product ratio. The sprayer can include an antisiphoning device in fluid communication with the first inlet to prevent concentrated liquid product from flowing outwardly of the first inlet.

The valve member of the sprayer can be a rotatable valve having a cylindrical body with upper and lower passages therethrough, the upper passage being in fluid communication with the first inlet and first outlet when the rotatable valve is in a first position and the lower passage being in fluid communication with the second outlet when the rotatable valve is rotated from the first position to a second position at which the upper passage is not in fluid communication with the first outlet. The housing can include a bore receiving the cylindrical body of the valve member and the housing can include an upper passage in fluid communication with the bore and first outlet and a lower passage in fluid communication with the bore and the second outlet. The valve member can include a seal member which sealingly engages with the upper and lower passages when the valve member is in an off position. The housing can include a cavity in fluid communication with the bore and the first inlet, the valve member being movable from the first position at which the cavity is in fluid communication with only the upper passage to the second position at which the cavity is only in fluid communication with the lower passage. The lower passage preferably includes an upstream portion and a downstream portion, the second inlet being in fluid communication with the downstream portion, and the downstream portion having a larger cross section than the upstream portion so that concentrated liquid product is siphoned into the downstream portion and mixed with water supplied through the upstream portion.

The water and concentrated liquid product can be supplied to the sprayer by a water hose and a container of the product, respectively. To attach the container, the housing can include a tubular projection and a rotatable fitting mounted on the tubular projection such that the rotatable fitting is engageable with the container. To attach the hose, the first inlet can comprise an internally threaded portion of the housing and the internally threaded portion can be attachable to a hose by screwing the internally threaded portion onto an externally threaded portion of the hose. Alternatively, the housing can include a tubular projection and a rotatable fitting mounted on the tubular projection such that the rotatable fitting is engageable with an end of the hose. The housing can comprise a single molded piece of plastic having an upper passage therethrough in fluid communication with the first outlet, a lower passage therethrough in fluid communication with the second outlet, and the mixing chamber located in the second passage.

The invention also provides a method of applying diluted liquid product to a surface to be treated by a sprayer attached to a hose for supplying water to a first inlet of the sprayer and a container having concentrated liquid product attached to a second inlet of the sprayer. The method includes spraying water through a first outlet in the sprayer by moving a valve member of the sprayer to a first position at which the first inlet is in fluid communication with the first outlet and mixing the concentrated liquid product with water to form a diluted product and spraying the diluted product from a second outlet in the sprayer by moving the valve member to a second position at which the first inlet is in fluid communication with the second outlet. The concentrated liquid product is preferably siphoned from the container and passes through an orifice plate having a plurality of openings therein which provides a substantially constant water/product ratio over water pressure variations in the water supplied through the inlet ranging from 40 to 60 psi. To provide desired spray patterns, the sprayer can include a cover mounted on the housing, the cover including a first outlet in fluid communication with the first outlet of the housing and a second outlet in fluid communication with the second outlet of the housing, the first and second outlets in the cover providing different spray patterns of the water-only rinse and diluted product, respectively. In a preferred embodiment, the concentrated liquid product is a concentrated liquid cleaning solution and the method comprises cleaning an outdoor surface by applying the diluted product to the surface, allowing the diluted product to remain on the surface for a period of time followed by rinsing the diluted product from the surface by spraying water through the first outlet of the sprayer.

BRIEF DESCRIPTION OF THE DRAWINGS

FIGS. 3*a–c* show details of the cover shown in FIG. 1, wherein FIG. 3*a* shows a longitudinal cross-sectional view of the cover, FIG. 3*b* shows a transverse cross-sectional view taken along the line A—A in FIG. 3*a* and FIG. 3*c* shows a top view of the cover shown in FIG. 3*a;*

FIGS. 5*a–d* show details of an antisiphoning device shown in FIG. 1 wherein FIG. 5*a* is an axial end view of a cylindrical member, FIG. 5*b* is a cross-sectional side view of the cylindrical member of FIG. 5*a*, FIG. 5*c* is a perspective side view of the cylindrical member shown in FIGS. 5*a–b* and FIG. 5*d* is a side view of a conical member which together with the cylindrical member forms the antisiphoning device;

DETAILED DESCRIPTION OF THE INVENTION

According to the invention, an improved sprayer is provided having improved consistency in water/product mixing ratios, range of delivery and/or different spray patterns for a water-only rinse or water/product mixture. The sprayer can incorporate a closed venturi system, an orifice plate delivery mechanism and/or a dual chamber exit for delivery of water-only from one exit hole and product from the other exit hole. The sprayer can also include a three-position valve for supplying water-only in a first position, a water/product mixture in a second position and preventing outflow of product or water in a third position.

Figure 1:
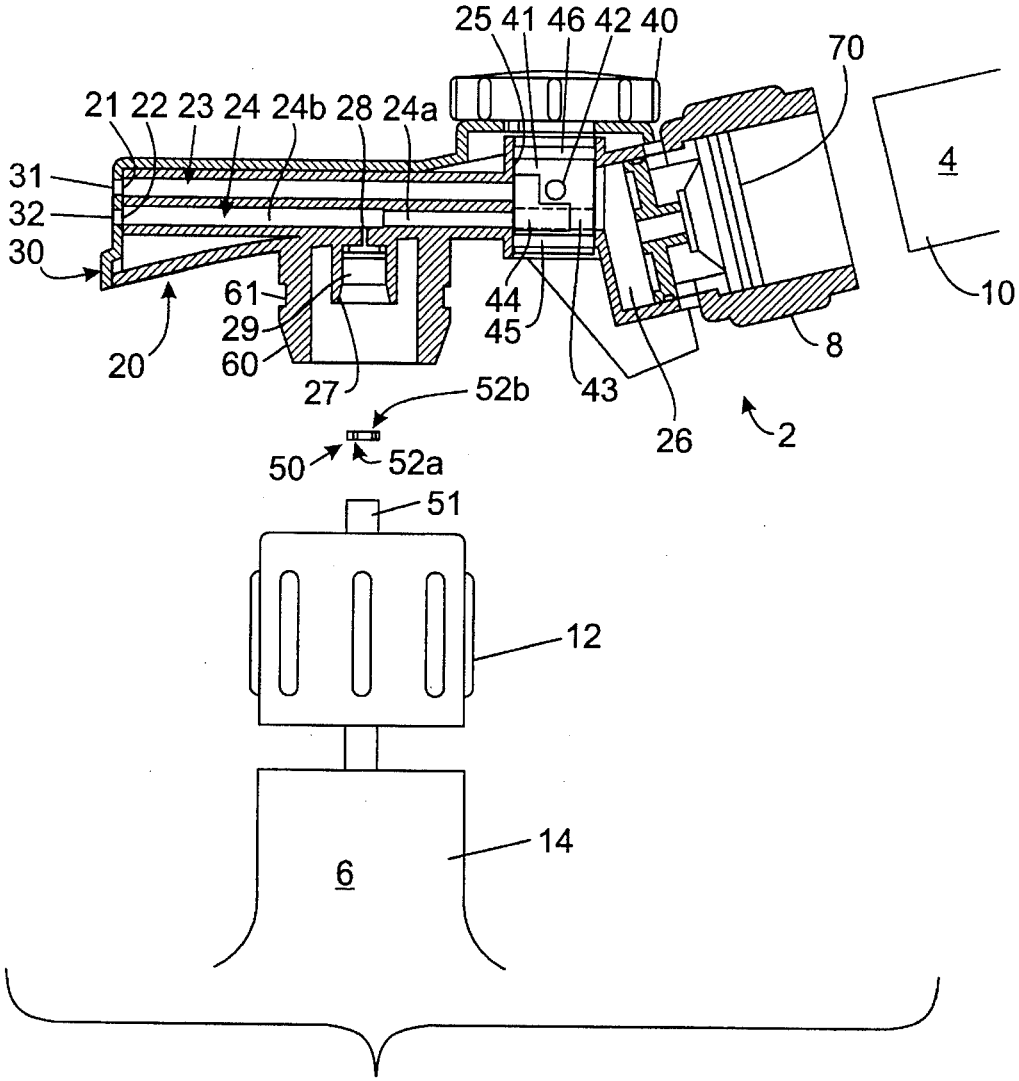
FIG. 1 shows a sprayer in accordance with the invention in a partially exploded and cross-sectional view.
Figures 5A, 5B:
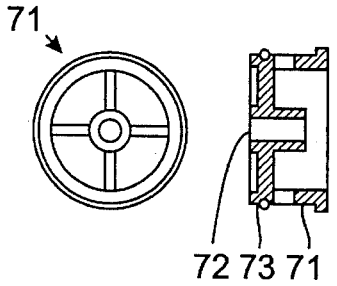
Figure 5C:
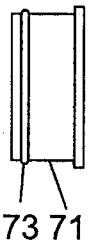
Figure 5D:
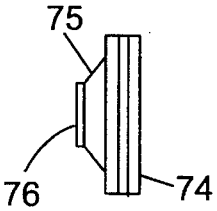

As shown in FIG. 1, the invention provides a sprayer 2 attachable to a free end of a hose 4 such as a garden hose. The sprayer is also attachable to a container 6 of product such as a concentrated cleaning solution. The concentrated cleaning solution can be a cleaning solution suitable for cleaning vinyl siding such as the cleaning solution disclosed in copending and commonly owned U.S. patent application Ser. No. 08/383,769, the disclosure of which is hereby incorporated by reference. The product is withdrawn from container 6 and mixed with a pressurized liquid such as water supplied by hose 4.

The sprayer 2 includes a first internally threaded fitting 8 for attachment to a threaded end 10 of hose 4 and a second internally threaded rotatable fitting 12 for attachment to a threaded outlet of 14 of container 6. Alternatively, a rotatable fitting could be used for attaching the hose 4 to the sprayer. Further, other methods of attaching hose 4 and container 6 could be substituted for the threaded fittings 8, 12, e.g., snap fittings, compression fittings, etc.

Figure 2:
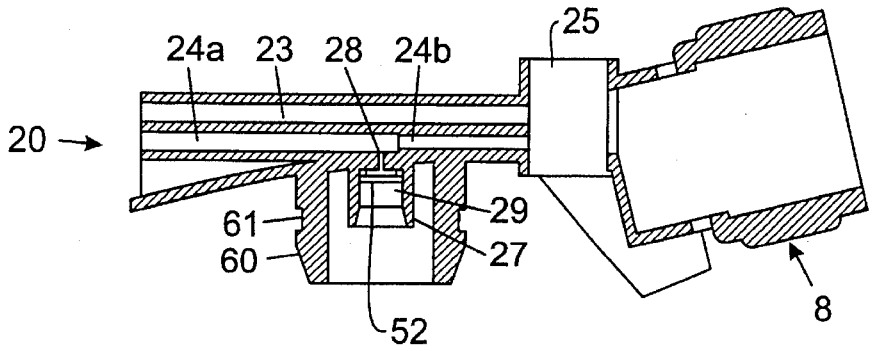
FIG. 2 shows a cross-sectional view of a housing of the sprayer shown in FIG. 1.
Figure 3A:
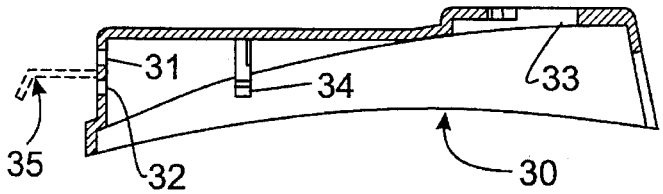
Figure 3B:
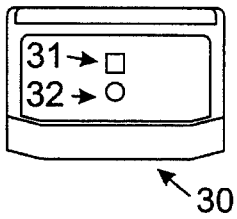
Figure 3C:
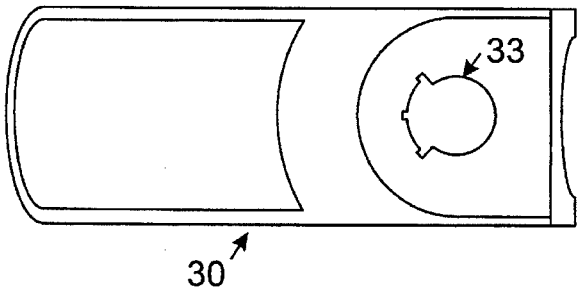

According to a preferred embodiment, sprayer 2 includes a housing 20, cover 30 and valve member 40. As shown in FIG. 2, the housing 20 has a dual outlet arrangement wherein an upper outlet 21 is a water-only outlet and a lower outlet 22 is a diluted product outlet. Likewise, as shown in FIGS. 3*a–c*, the cover 30 has an upper water-only outlet 31 and a lower diluted product outlet 32. The upper outlet 31 is supplied water through upper passage 23 in housing 20 and the lower outlet 32 is supplied diluted product through lower passage 24 in housing 20. With this arrangement, outlets 31, 32 can have different shapes and/or sizes to selectively provide desired spray patterns for the water-only and diluted product sprayed from the sprayer. For instance, by proper choice of the outlet size and/or shape, it is possible to apply the diluted product in a wide pattern and/or with moderate impact force on a surface to be coated with the diluted product. On the other hand, since the water-only rinse is applied through a different outlet, it is possible to apply the water-only rinse to the surface with a more narrow spray pattern and/or with greater impact force compared to the diluted product spray pattern.

Figure 4:
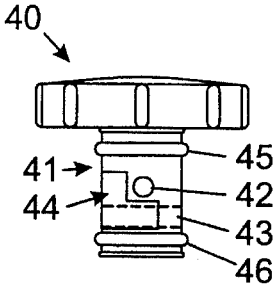
FIG. 4 shows details of the multi-position valve shown in FIG. 1.

With the dual outlet arrangement, it is desirable to utilize a multi-position valve member 40, as shown in FIG. 4, for selectively applying the water-only or diluted product to the respective outlets 31, 32. The valve member 40 is movable to first, second and third positions whereby outlets 31, 32 are prevented from spraying water-only or diluted product when valve member 40 is in the third position, outlet 32 is supplied diluted product and outlet 31 is prevented form spraying water-only when valve member 40 is in the second position and outlet 31 is supplied water-only and outlet 32 is prevented from spraying diluted product when valve member 40 is in the first position.

As shown in FIG. 4, the valve member 40 includes a cylindrical body 41 having upper passage 42 and lower passage 43. In order to supply water from hose 4 to passages 42 and 43, housing 20 includes a cavity 26 which is in fluid communication with upper and lower passages 42, 43. Body 41 is rotatably mounted in bore 25 of housing 20 such that upper passage 42 supplies water to upper outlet 31 through upper passage 23 when valve member 40 is in the first position. By rotating valve member 40 to the second position, upper passage 42 is rotated out of fluid communication with upper passage 23 and lower passage 43 in body 41 is aligned with lower passage 24 so that diluted product can be supplied to lower outlet 32. By rotating valve member 40 to the third position, upper passage 42 is out of fluid communication with upper passage 23 and lower passage 43 is out of fluid communication with lower passage 24. To prevent leakage, body 41 includes seal member 44 which sealingly engages inlets of passages 23, 24 and upper O-ring 45 and lower O-ring 46 prevent leakage between valve member 40 and housing 20.

In another preferred embodiment of the invention, concentrated product in container 6 is supplied to lower passage 24 via an orifice plate arrangement 50 mounted in tubular projection 27 in housing 20. In particular, concentrated product is withdrawn from container 6 through tube 51, passes through a plurality of holes 52*a*, 52*b* in orifice plate 52, through passage 28 in housing 20 and into lower passage 24. As shown in FIG. 2, plate 52 tightly fits within an opening 29 defined by tubular projection 27 and a free end of tube 51 sealingly engages the opening 29 such that plate 52 is located between tube 51 and passage 28. The orifice plate arrangement provides more uniform and consistent mixing of concentrated product with water within a desired range of water/product mixing ratios (e.g. 10 to 30 parts water to 1 part concentrated liquid product) over a wide range of water pressures (e.g., 40 to 60 psi) typically supplied by household exterior faucets.

According to a further embodiment of the invention, concentrated product is mixed with water in a closed venturi system. In particular, compared to prior art sprayers which utilize an open air mixing chamber, sprayer 2 achieves mixing of concentrated product from container 6 and water from hose 4 in lower passage 24 by providing passage 24 with a small diameter upstream portion 24*a* and a large diameter downstream portion 24*b*. To enhance mixing, upstream portion 24*a* can have a non-circular cross-section and downstream portion 24*b* can have a circular cross-section. Passage 28 is in fluid communication with downstream portion 24*b* and water passing under pressure through upstream passage 24*a* drops in pressure in downstream passage 24*b* thus creating a partial vacuum in an area of passage 28 and drawing concentrated product up through tube 51 and into downstream passage 24*b* wherein the concentrated product is thoroughly mixed with the water.

According to another embodiment of the invention, fitting 8 is integral with housing 20, e.g., fitting 8 and housing 20 can be injection molded from plastic in one piece, as shown in FIG. 2. In this case, the housing can be screwed onto the hose 4 prior to attaching the container 6. To allow easier attachment of container 6, housing 20 can include a tubular projection 60 which has an annular recess 61 on the outer periphery thereof. Fitting 12 snap fits over projection 60 by engaging recess 61 with a suitable mating annular flange (not shown) whereby end 14 of container 6 can be screwed into fitting 12 by rotating fitting 12. If desired, another rotatable fitting arrangement as used to attach container 6 can be used to attach hose 4.

The sprayer 2 can include an antisiphoning device 70 to prevent backflow of concentrated liquid product outwardly of inlet 8 and into hose 4. As shown in FIGS. 5*a–d*, device 70 includes cylindrical member 71 having a central passage 72 therein for directing water to cavity 26, O-ring 72 for sealingly engaging an outer periphery of member 71 with an inner wall of fitting 8 and conical member 74 having a conical wall 75 and central passage 76 in fluid communication with passage 72. The antisiphoning device includes a flapper (not shown) to prevent backflow of fluid in the hose 4. The antisiphoning device can have other suitable configurations such as of the type incorporated in aspiration-type sprayers made by Hayes Products or comprise a backflow valve as disclosed in U.S. Pat. No. 2,646,063.

Figure 6A:
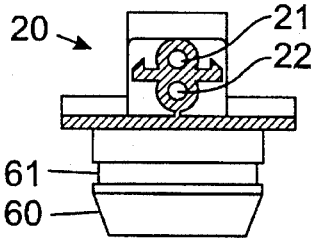
FIGS. 6*a–b* show details of the housing of the sprayer shown in FIG. 1, FIG. 6*a* showing an axial end view in partial cross-sect a top view of the housing.
Figure 6B:
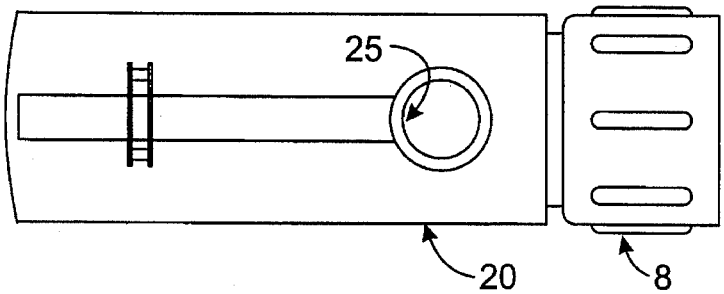
Figure 7A:
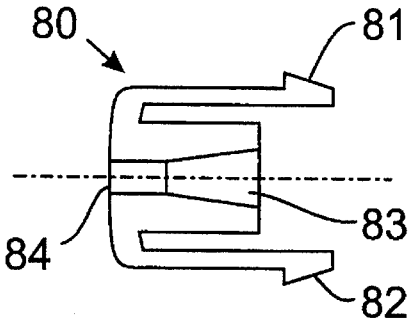
FIGS. 7*a–c* show details of an embodiment of the housing of the sprayer shown in FIG. 1, FIG. 7*a* showing a top view in cross-section of a snap-on spray pattern member, FIG. 7*b* showing a side view in cross-section of the member shown in FIG. 7*a*, and FIG. 7*c* showing a front view of the member shown in FIG. 7*a*.
Figure 7C:
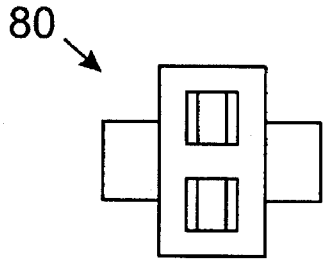
Figure 7B:
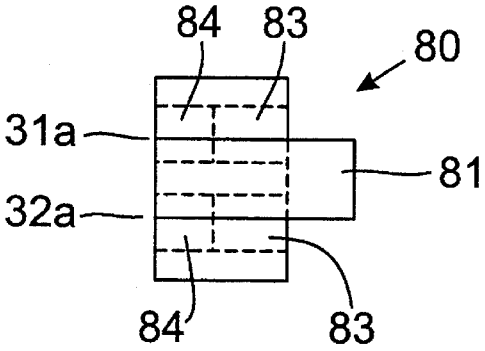
Figure 8A:
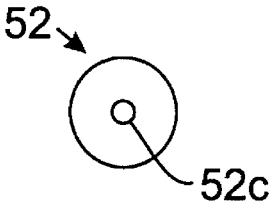
FIGS. 8*a–b* show details of an embodiment of the orifice plate shown in FIG. 1.
Figure 8B:
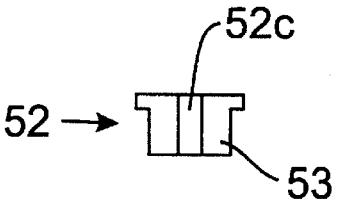
Figure 9A:
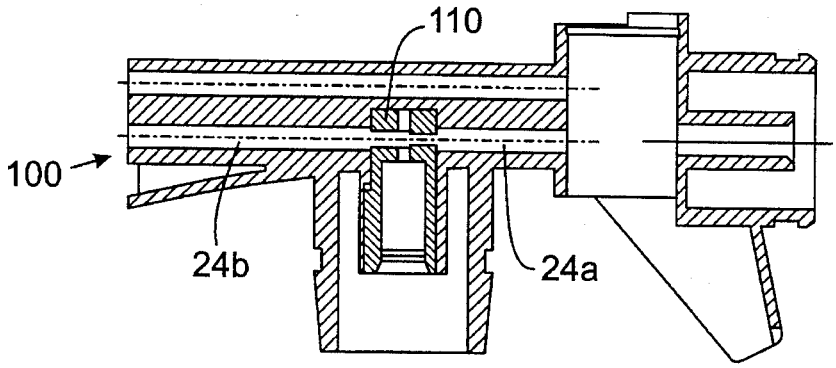
Figure 9B:
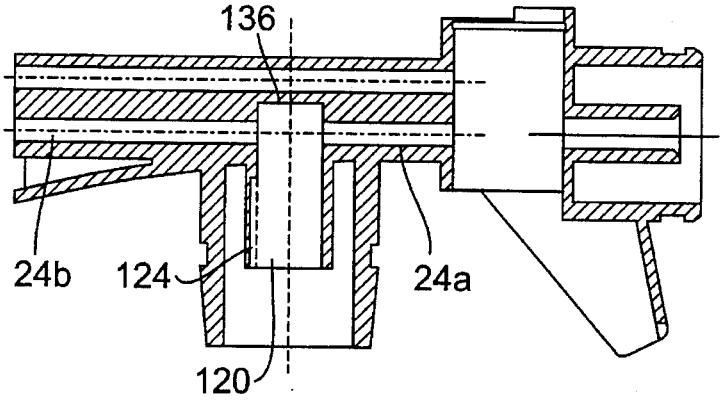
Figure 9C:
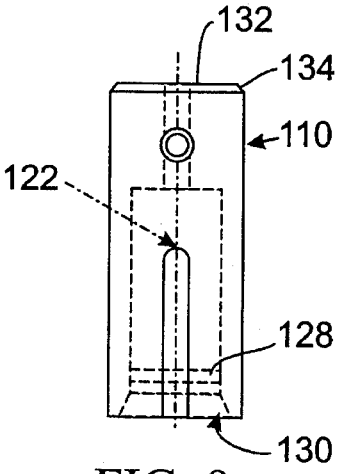
Figure 9D:
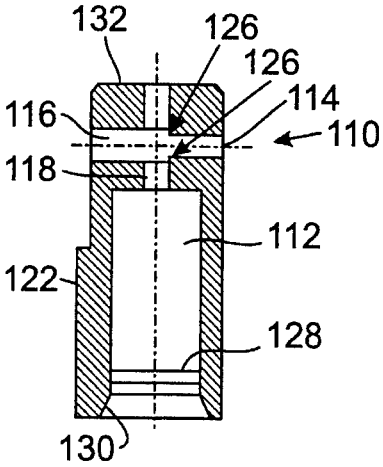
Figure 9E:
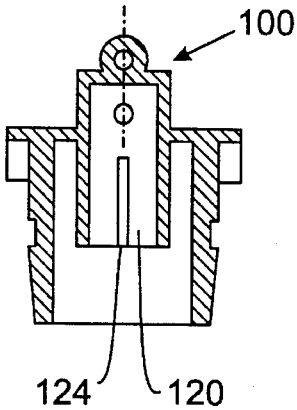

As shown in FIGS. 6*a–b*, housing 20 includes snap fitting member 80 which engages mating projection 34 on cover 30 (see FIG. 3*a*). With this arrangement, cover 30 can be replaced or interchanged with another cover having different size and/or shaped outlets 31, 32. Also, cover 30 can include a deflector for diverting the water-rinse or diluted product sprayed from exit holes 31 and/or 32. For instance, as shown in phantom in FIG. 3*a*, cover 30 can include deflector 35 for diverting the diluted product spray thus providing a wide spray pattern for spraying the diluted product on nearby horizontal surfaces such as wooden decks, driveways, etc.

With the sprayer arrangement described above, it is possible to mix highly concentrated cleaning solution with water supplied from a garden hose and apply the thus diluted cleaning solution to outdoor surfaces such as vinyl siding of a building. The sprayer can provide a one-foot wide spray pattern at a distance of 8 feet. Further, at a water pressure of 60 psi at the hose end, the sprayer can deliver the diluted product to heights of 30 feet and provide a rinsing spray of water-only at such distances. Moreover, the delivery of product and water-only rinse to the desired distances such as the top of a two-story wall of a building can be achieved while maintaining a substantially constant water/product mix ratio, e.g., 20:1 water to product ratio.

In accordance with a preferred embodiment of the invention, a mixing ratio of about 20:1 water to product is achieved using an orifice disk with two holes having diameters of 0.031 inch and configuring the lower passage 24 such that the upstream portion 24*a* has a diameter of 0.092 inch and the downstream portion 24*b* has a diameter of 0.116 inch. Also, water and concentrated product are mixed in downstream portion 24*b* which has length of 0.875 inch. The upper passage 23 for the water rinse has a diameter of 0.140 inch. This arrangement was compared to a single orifice arrangement having a orifice disk with a single hole having a diameter of 0.042 inch. The results of the testing are set forth in the following Table 1.

TABLE 1

| | Water Pressure | 40 P.S.I. | 50 P.S.I. | 60 P.S.I. |
|---|---|---|---|---|
| Single Orifice | Time/10 Gals. | 7 Min. | 6 Min. | 5 Min. |
| | Water/Product | 5 Sec. | 10 Sec. | 35 Sec. |
| | Product Flow | 54 Ozs. | 64 Ozs. | 76 Ozs. |
| | Water/Product Ratio | 22.70:1 | 19:1 | 15.84:1 |
| | Time/24 Ozs. Product | 3 Min. 9 Sec. | 2 Min. 19 Sec. | 1 Min. 46 Sec. |
| Double Orifice | Time/10 Gals. | 7 Min. | 6 Min. | 5 Min. |
| | Water/Product | | 5 Sec. | 30 Sec. |
| | Product Flow | 56 Ozs. | 56 Ozs. | 57½ Ozs. |
| | Water/Product Ratio | 21.85:1 | 21.85:1 | 21.26:1 |
| | Time/24 Ozs. Product | 3 Min. | 2 Min. 36 Sec. | 2 Min. 18 Sec. |

As shown in the above Table 1, with the double orifice arrangement according to the invention, it is possible to maintain a desired water/product ratio of about 21 to 22:1 over a water pressure range of 40–60 psi whereas with a single orifice arrangement the water:product ratio varied widely from about 16 to 23:1 over the same water pressure range.

A variation of the cover 30 is shown in FIGS. *7a–c*. In this embodiment, outlets 31, 32 of cover 30 can be omitted and instead a larger single opening 36 can be provided in cover 30, as shown in phantom in FIG. *3b*. Opening 36 should be large enough to allow rinse water flowing through passage 23 or diluted product flowing through passage 24*a* to pass therethrough. In order to provide desired spray patterns for the rinse and diluted product, respectively, snap-on spray pattern member 80 includes outlets 31*a*, 32*a* extending therethrough. Outlet 31*a* is aligned with passage 23 and outlet 32*a* is aligned with passage 24*a* when member 80 is attached to cover 30. In order to attach member 80 to cover 30, cover 30 includes openings 37, 38 (as shown in phantom in FIG. *3c*) and member 80 includes snap-fit projections 81, 82 thereon for engaging openings 37, 38. Each of the exit portions of outlets 31*a*, 32*a* is rectangular in shape, as shown in FIG. *7c*. Each outlet 31*a*, 32*a* includes a first V-shaped tapered portion 83 and a second rectangular shaped portion 84 of uniform cross-section, as shown in FIG. *7a*. As shown in FIG. *7c*, the tapered portion 83 is formed by a pair of planar vertical walls which converge towards the portion 84 of uniform cross-section. In the embodiment shown, the outlets 31*a*, 32*a* have exit openings in the shape of rectangles which are 0.092 inch in horizontal dimension and 0.20 inch in vertical dimension. The tapered portion 83 has an entrance opening in the shape of a square with dimensions of 0.20 inch on each side. The outlets 31*a*, 32*a*, however, can have any suitable size and/or shape. Thus, the arrangement shown in FIG. *7a–c* allows the spray pattern to be easily changed by attaching member 80 having the desired size and/or shaped outlets therein.

As shown in FIGS. *8a–b*, the orifice plate 52 can be mounted in the upper end of the tube 51. In this case, orifice plate 52 can include a single orifice 52*c* extending axially through projection 53. Projection 53 tightly fits within the opening of tube 51, thus allowing easy mounting of the orifice plate and simple adjustment of product dilution ratios based on the size of the opening 52*c*. Tube 51 can comprise a standard dip tube having an inner diameter of 0.1875 inch and an outer diameter of 0.25 inch. Projection 53 and orifice plate 52 can be molded as a single piece of plastic or other material having a length of about 0.125 inch. With this arrangement, orifice plate 52 can be located between tube 51 and passage 28 with tube 51 sealingly engaging opening 29. Product dilution ratios obtainable with different hole sizes 52*c* are exemplified in the following Table 2.

TABLE 2

| Water/ Product Ratio | 10:1 | 11:1 | 12:1 | 13:1 | 14:1 | 15:1 | 16:1 | 17:1 | 18:1 | 19:1 | 20:1 |
|---|---|---|---|---|---|---|---|---|---|---|---|
| Orifice Diameter (inch) | 0.043 | 0.042 | 0.041 | 0.040 | 0.039 | 0.038 | 0.037 | 0.036 | 0.035 | 0.034 | 0.033 |

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A portable sprayer for applying a diluted product to a surface to be treated, comprising:

a housing having first and second inlets, first and second outlets, a mixing chamber and a valve member;

the first inlet supplying water to the sprayer;

the second inlet supplying a concentrated liquid product to the sprayer;

the mixing chamber being in fluid communication with the first and second inlets such that water is mixed with the concentrated liquid product to form a diluted product by feeding water through the first inlet and feeding the concentrated liquid product through the second inlet the housing including a passage in fluid communication with the first and second inlets and second outlet, the passage including an upstream portion and a downstream portion, the second inlet being fluid communication with the downstream portion, and the downstream portion having a larger cross section than the upstream portion so that concentrated liquid product is siphoned into the downstream portion and mixed with water supplied through the upstream portion to provide the diluted product, the diluted product being conveyed in the downstream portion without exposure to atmospheric air until the diluted product is sprayed through the second outlet;

the first outlet spraying rinsing water from the sprayer to allow removal of diluted product from a surface to be treated;

the second outlet spraying the diluted product from the sprayer onto a surface to be treated; and the valve member being operable to selectively feed the diluted product to the second outlet or feed rinsing water to the first outlet or prevent rinsing water from flowing to the first and second outlets.

2. The sprayer of claim 1, further comprising a container of the concentrated liquid product, the container being attached to the sprayer and the sprayer including a siphoning tube extending into the container, the second inlet being in fluid communication with the siphoning tube and the concentrated liquid product being removed from the container by feeding water through the mixing chamber and siphoning the concentrated liquid product from the container.

3. The sprayer of claim 2, further comprising an orifice member in fluid communication with the second inlet, the orifice member including a single passage therethrough which supplies concentrated liquid product to the mixing chamber, the orifice member including a projection fitted in the siphoning tube.

4. The sprayer of claim 1, further comprising an orifice member in fluid communication with the second inlet, the orifice member including a plurality of passages therethrough which supply concentrated liquid product to the mixing chamber in a substantially constant water/product ratio.

5. The sprayer of claim 1, including an antisiphoning device in fluid communication with the first inlet, the antisiphoning device preventing flow of concentrated liquid product outwardly from the first inlet.

6. The sprayer of claim 1, wherein the valve member comprises a rotatable valve, the rotatable valve including a cylindrical body having upper and lower passages therethrough, the upper passage being in fluid communication with the first inlet and first outlet when the rotatable valve is in a first position and the lower passage being in fluid communication with the second outlet when the rotatable valve is rotated from the first position to a second position at which the upper passage is not in fluid communication with the first outlet.

7. The sprayer of claim 1, wherein the housing includes a bore and the valve member includes a cylindrical body fitted in the bore of the housing, the housing further including an upper passage in fluid communication with the first outlet and a lower passage in fluid communication with the second outlet, the valve member including a seal member which sealingly engages with the upper and lower passages by rotating the valve member to an off position.

8. The sprayer of claim 1, wherein the housing includes a bore receiving the valve member, an upper passage extending between the bore and the first outlet, a second passage extending between the bore and the second outlet, and a cavity in fluid communication with the bore and the first inlet, the valve member being movable from a first position at which the cavity is in fluid communication with only the upper passage to a second position at which the cavity is only in fluid communication with the lower passage.

9. The sprayer of claim 1, wherein the housing includes a tubular projection and a siphoning tube attached to the tubular projection, the housing including a passage in fluid communication with the siphoning tube and the second outlet.

10. The sprayer of claim 1, further including a tubular projection extending from the housing and a rotatable fitting mounted on the tubular projection, the rotatable fitting being engageable with a container for holding the concentrated liquid product.

11. The sprayer of claim 1, wherein the first inlet comprises an internally threaded portion of the housing, the internally threaded portion being attachable to a garden hose by screwing the internally threaded portion onto an externally threaded portion of the garden hose.

12. The sprayer of claim 1, further including a tubular projection extending from the housing and a rotatable fitting mounted on the tubular projection, the rotatable fitting being engageable with a garden hose for supplying water to the first inlet.

13. The sprayer of claim 1, wherein the housing comprises a molded piece of plastic having upper and lower passages therethrough, the upper passage being in fluid communication with the first outlet and the lower passage being in fluid communication with the second outlet, the mixing chamber being located in the second passage.

14. The sprayer of claim 1, further comprising a cover member attached to the housing, the cover member including first and second outlets, the first outlet of the cover member being in fluid communication with the first outlet of the housing and the second outlet of the cover member being in fluid communication with the second outlet of the housing.

15. The sprayer of claim 14, wherein the cover member includes a spray pattern member attached thereto, the spray pattern member being snapped-fitted to the cover, the first and second outlets of the cover being located on the spray pattern member.

16. The sprayer of claim 1, further comprising an orifice member in fluid communication with the second inlet, the orifice member including a single passage therethrough which supplies concentrated liquid product to the mixing chamber.

17. A method of using a portable double barrel sprayer to selectively spray a water-rinse through a first outlet and spray a diluted liquid product through a second outlet, sprayer including a housing having first and second inlets, first and second outlets, a mixing chamber and a valve member; the first inlet supplying water to the sprayer; the second inlet supplying a concentrated liquid product to the sprayer; the mixing chamber being in fluid communication with the first and second inlets such that water is mixed with the concentrated liquid product to form a diluted product by feeding water through the first inlet and feeding the concentrated liquid product through the second inlet, the housing including a passage in fluid communication with the first and second inlets and second outlet, the passage including an upstream and a downstream portion, the second inlet being in fluid communication with the downstream portion, and the downstream portion having it larger cross section an than upstream portion so that concentration liquid product is siphoned into the downstream portion and mixed with water supplied through the upstream portion to provide the diluted product, the diluted product being conveyed in the downstream portion without exposure to atmoshperic air until the diluted product is sprayed through the second outlet; the first outlet spraying rinsing water from the sprayer to allow removal of diluted product from a surface to be treated; the second outlet spraying the diluted product from the sprayer onto a surface to be treated; and the valve member being operable to selectively feed the diluted product to the second outlet or feed rinsing water to the first outlet or prevent rinsing water from flowing to the first and second outlets, the method comprising:

mixing the concentrated liquid product with water to form a diluted product and spraying the diluted product onto a surface to be treated, the diluted product being sprayed through the second outlet of the sprayer by moving a valve member of the sprayer to a position at which the first and second inlets are in fluid communication with the second outlet; and removing the diluted product from the surface by spraying a water-only rinse onto the surface, the water-only rinse being sprayed through the first outlet of the sprayer by moving the valve member of the sprayer to a position at which the first inlet is in fluid communication with the first outlet.

18. The method of claim 17, wherein the concentrated liquid product is siphoned from the container and passes through an orifice plate having a plurality of openings therein which provides a substantially constant water/product ratio over water pressure variations in the water supplied through the inlet ranging from 40 to 60 psi.

19. The method of claim 17, wherein the sprayer includes a housing having first and second passages, the first passage being in fluid communication with the first outlet and the first inlet, the second passage being in fluid communication with the second outlet and the first and second inlets, the mixing being carried out in the second passage and the water-only rinse being supplied through the first passage.

20. The method of claim 17, wherein the sprayer includes a housing having the first and second outlets therein and a cover mounted on the housing, the cover including a first outlet in fluid communication with the first outlet of the housing and a second outlet in fluid communication with the second outlet of the housing, the first and second outlets in the cover providing different spray patterns of the water-only rinse and diluted product, respectively.

21. The method of claim 21, wherein the housing includes a removable spray pattern member, the first and second outlets being provided in the spray pattern member.

22. The method of claim 17, wherein the valve member includes first and second passages therethrough, the first passage being in fluid communication with the first inlet and first outlet when the valve member is in the first position and the second passage being in fluid communication with the first inlet and the second outlet when the valve member is in the second position.

23. The method of claim 17, wherein the concentrated liquid product is a concentrated liquid cleaning solution, the method comprising removing mold, mildew, algae and/or stains from an outdoor vinyl surface by applying the diluted liquid product to the surface, allowing the diluted liquid product to remain on the vinyl surface for a period of time followed by rinsing the diluted product from the vinyl surface by spraying water through the first outlet of the sprayer.

24. The method of claim 17, wherein the concentrated liquid product is siphoned from the container and passes through an orifice plate having a single opening therein.

25. The method of claim 17, wherein the sprayer includes a housing having the first and second outlets therein and a cover mounted on the housing, the cover including a first outlet in fluid communication with the first outlet of the housing and a second outlet in fluid communication with the second outlet of the housing, each of the first and second outlets in the cover including a tapered portion receiving the diluted product or water-only rinse sprayed through the first and second outlets of the housing.

* * * * *

UNITED STATES PATENT AND TRADEMARK OFFICE

CERTIFICATE OF CORRECTION

PATENT NO. : 5,595,345

DATED : January 21, 1997

INVENTOR(S) : William D. CHURA ET AL.

It is certified that error appears in the above-indentified patent and that said Letters Patent is hereby corrected as shown below:

In the Drawings, delete "FIGS. 9a-9e".

On the title page, "4 Drawing Sheets" should read -- 3 Drawing Sheets --

Signed and Sealed this

Third Day of February, 1998

*Attest:*

Bruce Lehman

BRUCE LEHMAN

*Attesting Officer*

*Commissioner of Patents and Trademarks*